US010631595B2

(12) United States Patent
Tanev

(10) Patent No.: US 10,631,595 B2
(45) Date of Patent: Apr. 28, 2020

(54) WEIGHT FOR ATTACHMENT TO A PIECE OF FOOTWEAR

(71) Applicant: Michael Tanev, Scarborough (CA)

(72) Inventor: Michael Tanev, Scarborough (CA)

( * ) Notice: Subject to any disclaimer, the term of this patent is extended or adjusted under 35 U.S.C. 154(b) by 133 days.

(21) Appl. No.: 15/689,405

(22) Filed: Aug. 29, 2017

(65) Prior Publication Data

US 2019/0059519 A1 Feb. 28, 2019

(51) Int. Cl.

| | |
|---|---|
| ***A43C 5/00*** | (2006.01) |
| ***A43B 19/00*** | (2006.01) |
| ***A43C 19/00*** | (2006.01) |
| ***A63B 21/00*** | (2006.01) |
| *A43B 23/24* | (2006.01) |
| *A43B 3/00* | (2006.01) |
| *A43B 5/16* | (2006.01) |

(52) U.S. Cl.

CPC ..... *A43C 5/00* (2013.01); *A63B 21/4015* (2015.10); *A43B 3/0078* (2013.01); *A43B 5/1666* (2013.01); *A43B 19/005* (2013.01); *A43B 23/24* (2013.01); *A43C 19/00* (2013.01)

(58) Field of Classification Search

CPC ..... A43C 5/00; A43C 19/00; A63B 21/4015; A63B 19/005; A43B 23/24

USPC ..... 36/50.1, 132, 136

See application file for complete search history.

(56) References Cited

U.S. PATENT DOCUMENTS

| | | | | |
|---|---|---|---|---|
| 3,582,067 | A | 6/1971 | Rucks | |
| 3,870,328 | A | 3/1975 | Gemmel et al. | |
| 3,901,524 | A | 8/1975 | Ouellette | |
| 4,458,432 | A | 7/1984 | Stempski | |
| 4,777,743 | A | 10/1988 | Roehrig, Jr. | |
| 4,916,833 | A * | 4/1990 | Nwoko | A43C 1/00 24/712.2 |
| 5,162,032 | A | 11/1992 | Dohner | |
| 5,209,000 | A * | 5/1993 | Rowland | A43B 1/0072 2/245 |
| 5,632,709 | A | 5/1997 | Walsh | |
| 6,010,438 | A | 1/2000 | Fitzgerald | |
| 6,412,197 | B1 * | 7/2002 | Krull | A43B 3/0078 24/712.2 |
| 7,000,337 | B2 | 2/2006 | Harrington | |
| 7,063,650 | B1 | 6/2006 | Beausoleil | |
| 2001/0000835 | A1 * | 5/2001 | Hines | A43B 13/38 36/132 |
| 2002/0017039 | A1 | 2/2002 | Hines | |
| 2007/0222203 | A1 | 9/2007 | McLeod | |
| 2008/0098625 | A1 | 5/2008 | Salvatore | |
| 2010/0269373 | A1 * | 10/2010 | Pirkle | A43C 7/00 36/136 |

(Continued)

OTHER PUBLICATIONS

Jolie Shoe Weights—E-Bay List dated May 20, 2009—8 pages.

(Continued)

*Primary Examiner* — Ted Kavanaugh

(74) *Attorney, Agent, or Firm* — Bereskin & Parr LLP/S.E.N.C.R.L., s.r.l.

(57) ABSTRACT

A weight for attachment to a piece of footwear includes a first weighted member having a plurality of holes arranged along a length of the weighted member and extending between a first face of the weighted member and a second face of the weighted member. A channel extends between a perimeter of one of the plurality of holes and a perimeter of the weighted member.

20 Claims, 7 Drawing Sheets

(56) References Cited

U.S. PATENT DOCUMENTS

2010/0299966 A1* 12/2010 Tanev ..... A43B 3/0078
36/132

OTHER PUBLICATIONS

Read Product Reviews—2 page document. Accessed at least as early as Sep. 25, 2009.
Shoe Weights Make Walking a Workout—4 page document. Accessed at least as early as Sep. 25, 2009.
Shoe Irons Champion Series—1 page advertisement. Accessed at least as early as Sep. 25, 2009.
Hockey Shot Get Into Hockey Training—5 page advertisement. Accessed on Apr. 20, 2009.

* cited by examiner

110a
T2
122a
117
120a
118a
136a
124a
116a
134a

110a
T1
122a
117
118a
136a
124a
120a
116a
134a 114a
136a
118a
117a
112a
124a
110a
134a
116a 126a
122a
132a
130a
L2
128a 136a
112a
118a
120a
124a
A1
117a
134a
116a
114a
110a 121a
112a
7
7
L1
117
134a
116a
124a
114a
120a
110a

WEIGHT FOR ATTACHMENT TO A PIECE OF FOOTWEAR

FIELD

The specification relates to weights, and more particularly, weights for attachment to a piece of footwear, such as a shoe or a skate.

INTRODUCTION

The following is not an admission that anything discussed below is prior art or part of the common general knowledge of persons skilled in the art.

U.S. Pat. No. 7,000,337 discloses a removable shoe weight for use in combination with a laced shoe. The shoe weight comprises a flexible packet consisting of a uniform material and having a longitudinal centerline aligned with the longitudinal axis of the shoe.

U.S. Patent Publication No. 2010/0299966 A1 discloses a weight for attachment to a piece footwear that includes a first weighted member having a plurality of holes defined therethrough. The holes are arranged along a length of the weighted member.

SUMMARY

The following summary is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

A weight for attachment to a piece of footwear is described herein. The weight may comprise first and second weighted members, which may be generally elongate, and may be attached to the sides of the piece of footwear along the lace-holes of the piece of footwear using the shoelace of the piece of footwear. By attaching the first and second weighted members to the sides of the piece of footwear, an equal distribution of weight may be provided to the piece of footwear, which may provide stability and balance to the wearer's body. In addition, a user may choose to have one side of the foot carry more weight than the other side. This may be useful for people having instep or arch problems with their feet. Further, by attaching the first and second weighted members along the lace-holes of the piece of footwear, discomfort to the top of the foot may be minimized. Further, by attaching the first and second weighted members using the shoelace of the piece of footwear, the first and second weighted members may be securely, snugly, and sleekly attached to the piece of footwear.

According to one broad aspect, a weight for attachment to a piece of footwear is provided. The weight comprises a first weighted member having a plurality of holes defined therethrough. The plurality of holes are arranged along a length of the weighted member.

According to another broad aspect, a weight for attachment to a piece of footwear is provided. The piece of footwear may have a first plurality of lace-holes on an outer side of the piece of footwear, and a second plurality of lace-holes on an inner side of the piece of footwear. At least one shoelace may be threadable through the lace-holes. The weight comprises a first weighted strip removably securable to the outer side of the piece of footwear. The first weighted strip has a first plurality of holes defined therethrough. The first plurality of holes are arranged along a length of the first strip, and at least some of the first plurality of holes are arranged to align with the first plurality of lace-holes. The first weighted strip is removably securable to the piece of footwear by the shoelace. The weight further comprises a second weighted strip removably securable to the inner side of the piece of footwear. The second weighted strip has a second plurality of holes defined therethrough. The second plurality of holes are arranged along a length of the second strip, and at least some of the second plurality of holes are arranged to align with the second plurality of lace-holes. The second weighted strip is removably securable to the piece of footwear by the shoelace.

According to another broad aspect, a method for applying a weight to a piece of footwear is provided. The piece of footwear comprises a first plurality of lace-holes on an outer side of the piece of footwear, and a second plurality of lace-holes on an inner side of the piece of footwear. The method comprises applying a first weighted member to the outer side of the piece of footwear; applying a second weighted member to the inner side of the piece of footwear; and securing the first weighted member and the second weighted member to the outer side of the piece of footwear and the inner side of the piece of footwear, respectively.

According to another broad aspect, there is provided a weight for attachment to a piece of footwear, the weight comprising: an elongate body having a plurality of holes arranged along a length of the body and extending between a first face of the body and a second face of the body, wherein a channel extends between a perimeter of one of the plurality of holes and a perimeter of the body.

In some embodiments, separate channels extend between a perimeter of each of the plurality of holes and the perimeter of the body.

In some embodiments, the body comprises a cover and a weighted portion.

In some embodiments, the weighted portion comprises a material having a density of about 3 to 6 grams/cubic centimeter.

In some embodiments, the material comprises at least one of lead, brass, and iron.

In some embodiments, the cover comprises a first covering strip adjacent to a first face of the body, and a second covering strip adjacent to a second face of the body.

In some embodiments, the channel is straight.

In some embodiments, the channel intersects the perimeter of the body at an angle of about 10 to 30 degrees.

In some embodiments, the channel intersects the perimeter of the body at an angle of about 20 degrees.

In some embodiments, a width of an outer end of the channel adjacent the perimeter of the weighted member is greater than a width of an inner end of the channel adjacent the perimeter of the hole.

In some embodiments, at least a portion of the body is flexible.

In some embodiments, the body is flexible.

In some embodiments, the body is resilient.

In some embodiments, the body is curved.

In some embodiments, the plurality of holes are arranged in a line.

In some embodiments, the line is curved.

In some embodiments, the plurality of holes comprises at least three holes.

In some embodiments, the body comprises a plastic material with embedded metal particles.

In some embodiments, the body has a density of about 3 to 6 grams/cubic centimeter.

In some embodiments, the body is substantially free of lead.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various embodiments will be described below to provide an example of each claimed invention. No embodiment described below limits any claimed invention and any claimed invention may cover embodiments that are not described below. The claimed inventions are not limited to embodiments having all of the features of any one embodiment described below or to features common to multiple or all of the embodiments described below. It is possible that a feature described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner (s) do not intend to abandon, disclaim, or dedicate to the public any such invention by its disclosure in this document.

Figure 1:
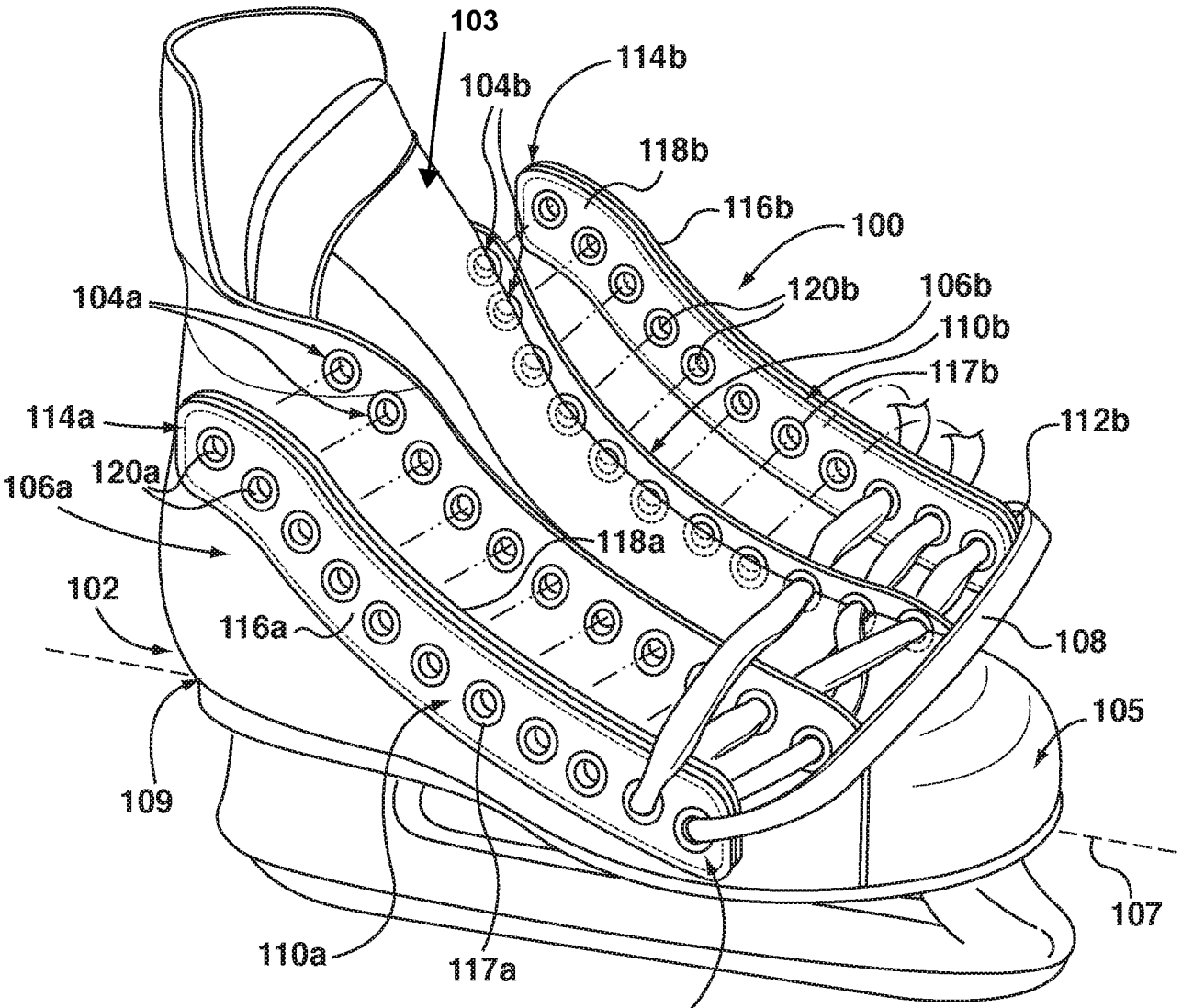
FIG. 1 is a perspective illustration of an embodiment of a weight in the process of being attached to an ice-skate.
Figure 2:
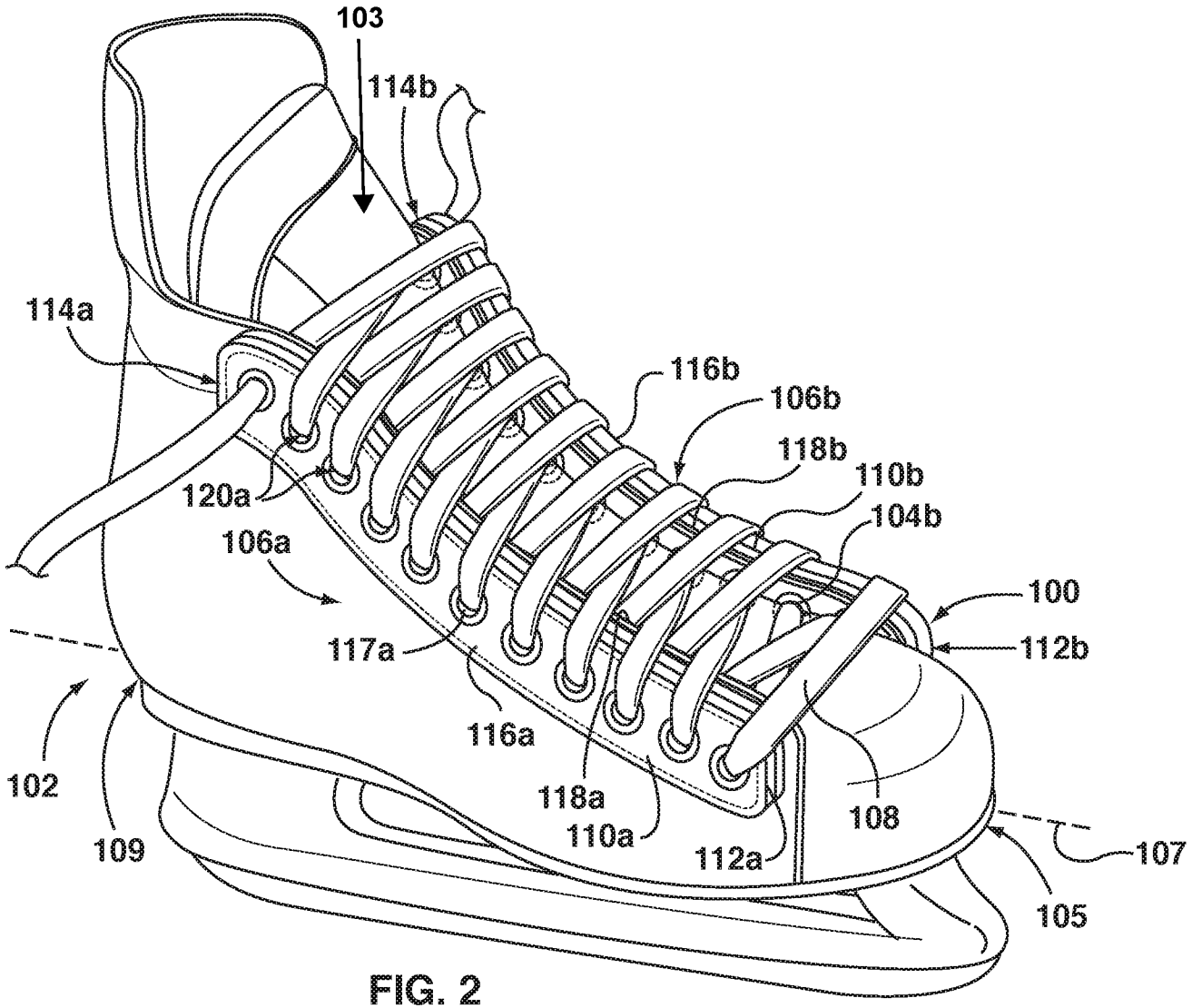
FIG. 2 is a perspective illustration of the weight of FIG. 1 attached to the ice-skate of FIG. 1.
Figures 3, 4, 5, 6, 7, 8:
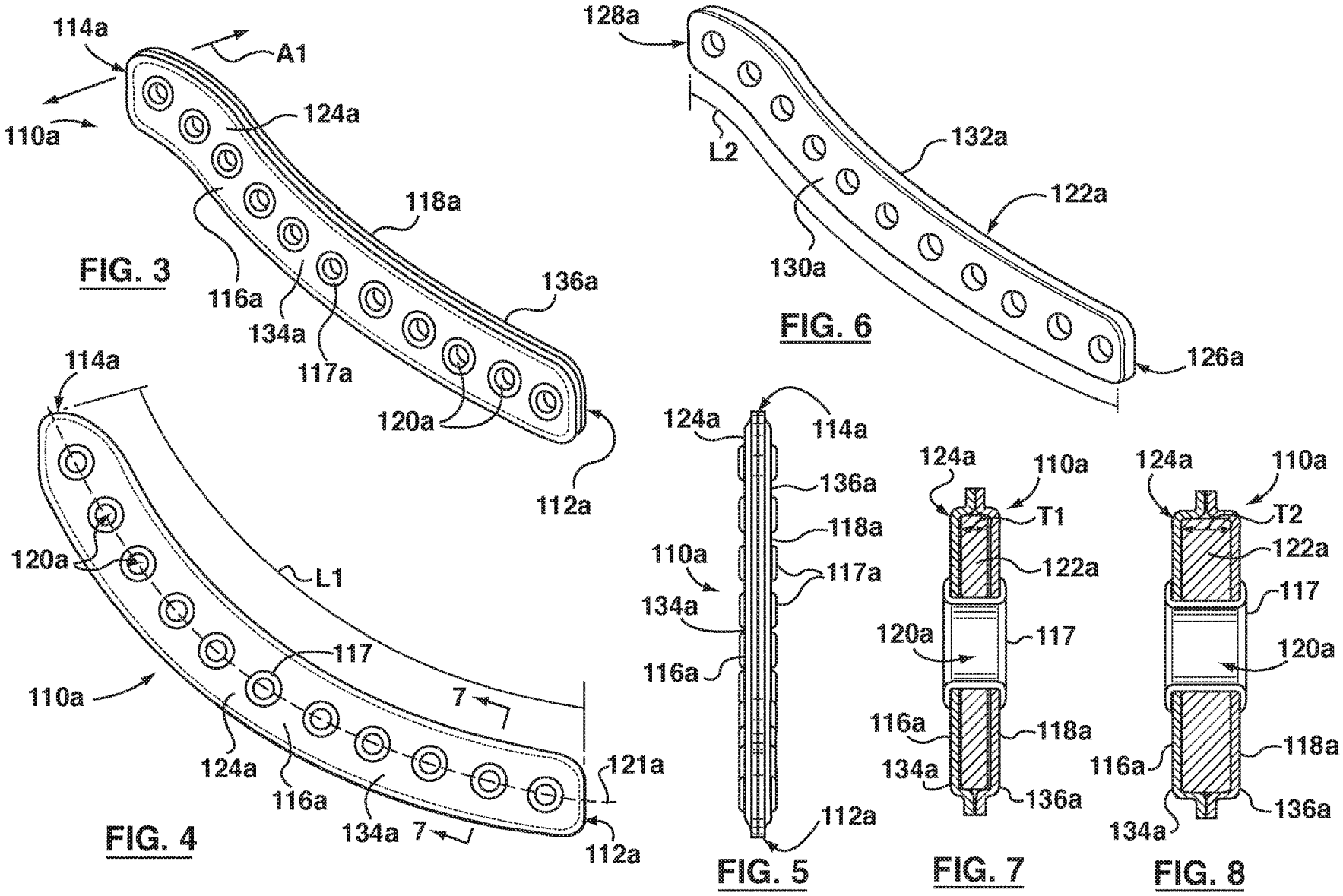
FIG. 3 is a perspective illustration of a weighted member of the weight of FIG. 1.
FIG. 4 is a side view of the weighted member of FIG. 3.
FIG. 5 is a front view of the weighted member of FIG. 3.
FIG. 6 is a perspective illustration of a weighted portion of the weighted member of FIG. 3.
FIG. 7 is a cross section taken along line 7-7 in FIG. 4.
FIG. 8 is an alternative embodiment of the cross-section shown in FIG. 7.

Referring to FIGS. 1 and 2, a weight 100 is shown in combination with a piece of footwear 102. In the embodiment shown, the piece of footwear 102 is an ice-skate. In alternative embodiments, the piece of footwear may be any other type of laced footwear, including but not limited to a shoe, a boot, an inline skate, a roller skate, a ski boot, or a snowboard boot. If the footwear is a shoe, it may be, for example an athletic shoe, an orthopedic shoe, or any other type of laced shoe. Athletic shoes may include cleats (as shown in FIG. 7), such as a soccer cleat, a football cleat, a baseball cleat, or a rugby cleat; spiked shoes such as golf shoes; running shoes (as shown in FIG. 8); walking shoes; climbing shoes; court shoes such as squash shoes; or high tops such as basketball shoes. If the footwear is a boot, it may be a combat boot, a construction boot, a snow boot, or any other type of laced boot.

As shown in FIG. 1, the piece of footwear 102 includes a first plurality of lace-holes 104*a* on an outer side 106*a* thereof, and a second plurality of lace-holes 104*b* on an inner side 106*b* thereof. A longitudinal axis 107 extends between a toe end 105 of the piece of footwear 102 and a heel end 109 of the piece of footwear 102, and divides the piece of footwear into the outer side 106*a* and the inner side 106*b*. A tongue 103 extends from the toe end 105 and is positioned generally between the lace-holes 104*a* and 104*b*. A shoelace 108 is threadable through the first plurality of lace-holes 104*a* and the second plurality of lace-holes 104*b*, to secure the piece of footwear to a user's foot, as is known in the art.

In the embodiment shown, the weight 100 comprises a first weighted member 110*a*, and a second weighted member 110*b*. The weighted members 110*a*, 110*b* are removably securable to the outer 106*a* and inner 106*b* sides of footwear, respectively. By securing the weighted member 110*a*, 110*b* to the outer 106*a* and inner 106*b* sides of the footwear, a substantially equal distribution of weight is provided to the foot, which provides stability and balance to the body. Preferably, as shown, the weighted members 110*a*, 110*b* are removably securable to the outer 106*a* and inner 106*b* sides of footwear using the shoelace 108, as will be described in further detail hereinbelow. By securing the weighted members 110*a*, 110*b* using the shoelace 108, the weighted members may be securely, snugly, and sleekly secured to the piece of footwear. Further, by securing the weighted members 110*a* and 110*b* using the shoelace 108, the weighted members 110*a* and 110*b* may be positioned substantially equidistantly from the longitudinal axis of the piece of footwear. This may further provide a substantially equal distribution of weight to the foot.

Referring now to FIGS. 3 to 5, a weighted member is shown. As described hereinabove, the weight shown comprises a first weighted member 110*a*, and a second weighted member 110*b*. For simplicity, a description will presently be made of the first weighted member 110*a*, and reference numerals with the suffix 'a' will be used. It will be appreciated that the second weighted member 110*b* may be substantially identical to, or a mirror image of, the first weighted member 110*a*, and like reference numerals ending with the suffix 'b' may be used to indicate like features on the second weighted member 110*b*.

In the embodiment shown, the first weighted member 110*a* is in the shape of a strip, and is generally elongate and has a first end 112*a*, a second end 114*a*, and a length L1 extending therebetween. The first weighted member 110*a* further has a first face 116*a* extending along the length thereof, and a second face 118*a* extending along the length thereof and opposed to the first face 116*a*. In use, the weighted member 110*a* is applied to the piece of footwear by positioning the second face 118*a* in facing relation to the outer side 106*a* of the piece of footwear 102.

The weighted strip 110*a* has a plurality of holes 120*a* defined therethrough, which are arranged along the length L1 of the weighted member 110*a*. The holes extend through the weighted member 110*a* from the first face 116*a* to the second face 118*a*. The holes 120*a* are generally arranged to align with the first plurality of lace-holes 104*a* of the piece of footwear when the weighted member 110*a* is placed on the piece of footwear 102, so that the shoelace 108 may be threaded therethrough. In the embodiment shown, the holes 120*a* are generally arranged at intervals along a curved line extending along the length of the weighted member. That is, they are aligned along a curved line 121*a*, which is a centerline of the weighted member in the illustrated example. In alternative embodiments, the holes may be arranged in another configuration. For example, the holes 120*a* may be arranged in two parallel lines. In the embodiment shown, an eyelet 117*a* is secured to each hole.

Preferably, the number of holes 120*a* in the weighted member 110*a* corresponds to the number of lace-holes 104*a* in the piece of footwear 102. For example, the ice-skate shown in FIG. 1 has 11 lace-holes, and the weighted member 110*a* has 11 lace-holes. Accordingly, each hole 120*a* is alignable with one of the lace-holes 104*a*. In alternative embodiments, however, the number of holes 120*a* in the weighted member 110*a* may not correspond to the number of lace-holes 104*a* in the piece of footwear 102. For example, the weighted member 110*a* may comprise only 5 holes, which may be staggered along the length thereof, such that every other lace hole 104*a* is aligned with a hole 120*a*. Alternatively, the weighted member 110*a* may comprise a number of holes 120*a* that is less than the number of lace-holes 104*a* on the piece of footwear 102, and the length L1 of the weighted member 110*a* may be sized to span only a portion of the row of lace-holes 104*a* on the footwear. For example, the weighted member 110*a* may comprise only 5 holes 120*a*, which may be alignable with the first 5 lace-holes 104*a* towards the toe end 105 of the ice-skate 102, and the length L1 of the weighted member 110*a* may be selected to span between the first five lace-holes 104*a*. In further alternative embodiments, only some of the holes 120*a* may align with a lace hole 104*a*. For example, the weighted member 110*a* may comprise 12 holes, only 11 of which align with the lace-holes 104*a*. Preferably, the weighted member 110*a* comprises at least three holes 120*a*, to provide three points of connection between the weighted member 110*a* and the piece of footwear 102.

The size of the holes 120*a* may vary depending on the particular embodiment. For example, in embodiments in which the weighted members 110*a*, 110*b* are sold for use with a children's shoe, the holes 120*a*, 120*b* may have a relatively small diameter, to match the size of the lace-holes. In embodiments in which the weighted members 110*a*, 110*b* are sold for use with an adult skate, the holes 120*a*, 120*b* may have a relatively large diameter. While holes 120*a* are preferably circular, they may alternatively be oval, a polygon, or any other suitable shape.

Referring now to FIGS. 6 to 8, in the embodiment shown, in order to provide the weighted member 110*a* with a sufficient amount of weight, the weighted member comprises a weighted portion 122*a*, and a cover 124*a*. The weighted portion 122*a* may comprise lead, for example, and may be in the form of a lead strip, having a first end 126*a*, an opposed second end 128*a*, a length L2 defined between the first end 126*a* and the second end 128*a*, a first face 130*a*, and an opposed second face 132*a*. It will be appreciated that the weighted portion may be made from any suitable material, including alloys or other multi-material compositions. Preferably, the weighted material has a relatively high density, which may reduce the overall size (e.g. volume) of a weighted member.

In the embodiment shown, the cover 124*a* comprises a first covering strip 134*a*, and a second covering strip 136*a*. The first 134*a* and second 136*a* covering strips may, for example, be made from leather, or a synthetic material such as nylon. The first covering strip 134*a* may be positioned adjacent the first face 130*a* of the weighted portion 122*a*, and the second covering strip 136*a* may be positioned adjacent the second face 132*a* of the weighted portion 122*a*. The weighted portion 122*a* and the first 134*a* and second 136*a* covering strips may be secured together by adhering the first 134*a* and second 136*a* covering strips to the weighted portion 122*a*. Alternatively or in addition, as shown, the edges of the first 134*a* and second 136*a* covering strips may be secured together around the weighted portion 122*a*, for example by stitching.

Referring to FIGS. 7 and 8, the weighted member 110*a* may be provided with varying amounts of weight. For example, some weighted members 110*a* may be sold as a 1 lb weight, and others may be sold as a 1.5 lb weight. Preferably, the weighted members are sold as any the following: a 0.25 lb weight, a 0.5 lb weight, a 0.75 lb weight, a 1.0 lb weight, a 1.25 lb weight, and a 1.5 lb weight. In order to provide the desired amount of weight, the thickness of the weighted portion 122*a* may be altered. For example as shown in FIG. 7, one embodiment of a weighted member 110*a* may include a weighted portion 122*a* a having a thickness T1, and, as shown in FIG. 8, another embodiment of a weighted member 110*a* may include a weighted portion 122*a* having a thickness T2, which is double the value of T1.

In some embodiments, the covering strips 134*a* and 134*b* may be color coded to correspond to the weight value of the weighted portion 122*a*. For example, weighted portions 122*a* that have a weight of 1 lb may be covered with covering strips 134*a*, 134*b* that are blue, and weighted portions 122*a* that have a weight of 1.5 lb may be covered with covering strips 134*a*, 134*b* that are red.

Referring back to FIG. 1, wherein the piece of footwear 102 is an ice-skate, the arrangement of lace-holes 104*a* and 104*b* on the ice-skate is curved upwards on ice-skate at the ankle portion of the ice-skate. As shown most clearly in FIG. 4, the first weighted member 110*a* is curved, in order to match the curved arrangement of the lace-holes 104*a*. Further, the line of holes 120*a* through the first weighted member 110*a* is curved (i.e. centreline 121*a* is curved). Accordingly, when the second face 118*a* of the first weighted member 110*a* is applied to the outer side 106*a* of the ice-skate, the holes 120*a* on the first weighted member 110*a* will align with the lace-holes 104*a*.

Additional embodiments in which the weighted member 110*a* is curved may include embodiments wherein the weighted member 110*a* is manufactured for use with boots such as combat boots or snow boots, ski-boots, and snowboard boots.

Figure 10:
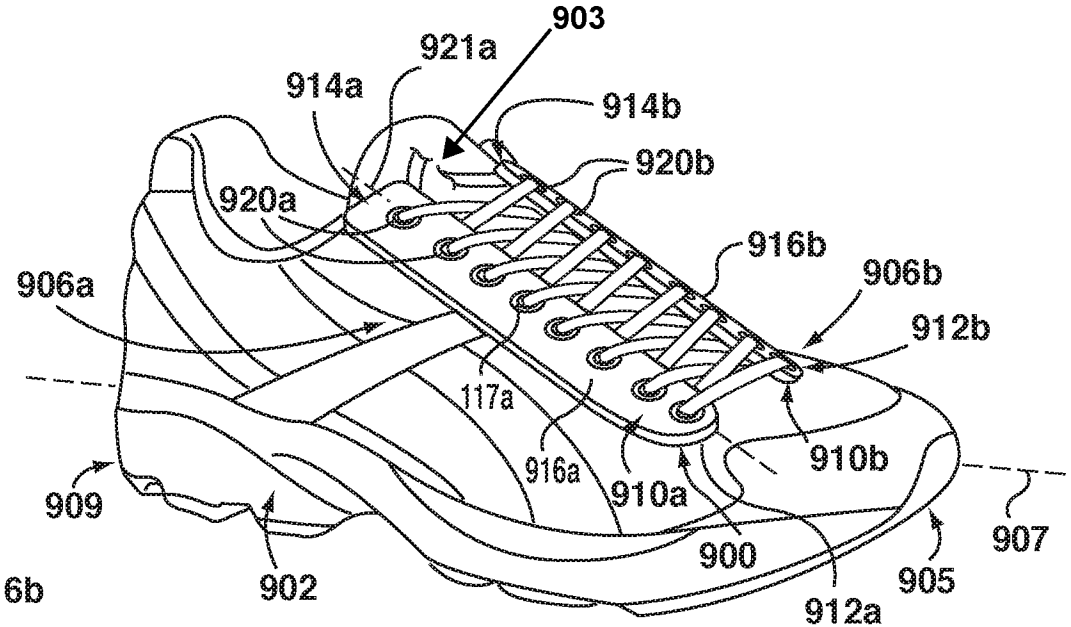
FIG. 10 is a perspective illustration of the weight of FIG. 9, attached to a running shoe.
Figure 9:
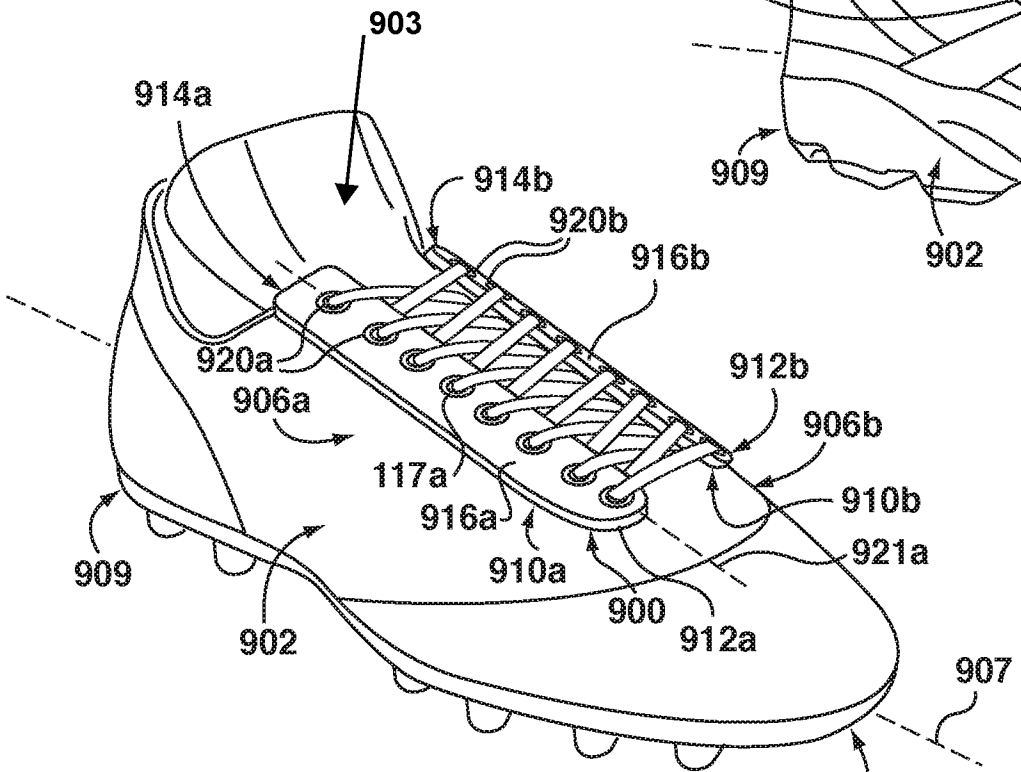
FIG. 9 is a perspective illustration of an alternative embodiment of a weight attached to a cleated shoe.
Figure 11:
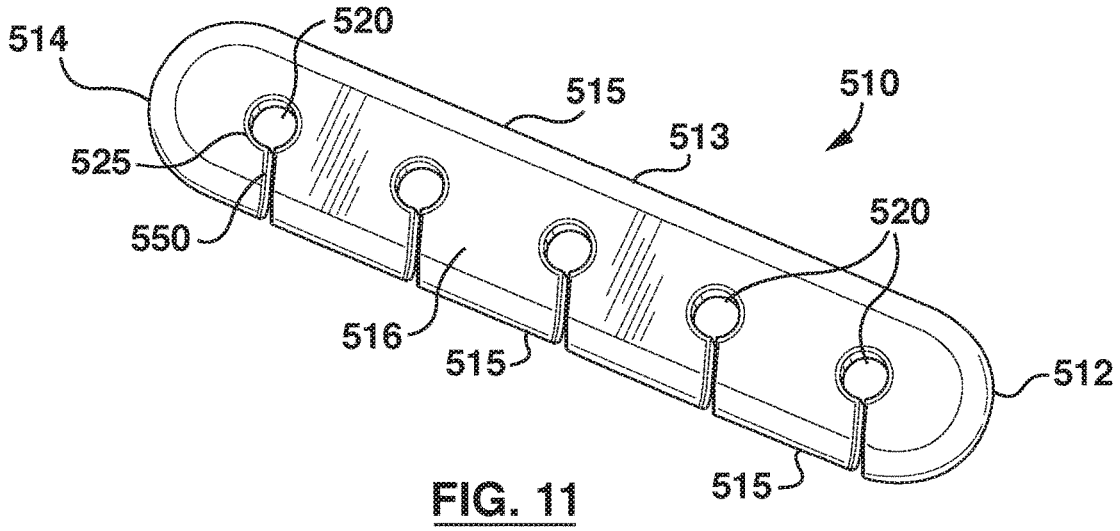
FIG. 11 is a perspective illustration of an alternative embodiment of a weight.

In an alternative embodiment, as shown in FIGS. 9 and 10, wherein like numerals are used to refer to like features, with the first digit of the numeral incremented to 9, the lace-holes 904*a*, 904*b* on the footwear 902 may be arranged in a generally straight line. In such embodiments, the weighted members 910*a* and 910*b* may be generally straight, and the line of holes 920*a* may be generally straight.

Although the embodiments of the weighted members 910*a* and 910*b* shown in FIGS. 9 and 10 are shown attached to a shoe, in which the lace-holes 904*a*, 904*b* are arranged in a generally straight line, it will be appreciated that such embodiments may also be attached to a piece of footwear wherein the arrangement of lace-holes is curved, such as an ice-skate. Particularly, although ice-skates are sold with various arrangements of lace-holes, the arrangement of first 5 or 6 lace-holes towards the toe end of the ice-skate is typically similar across most ice-skate designs, and includes a straight line of lace-holes. Accordingly, weighted members 910*a*, 910*b* may be sold for use with ice-skates, may have lace-holes 920*a*, 920*b* arranged in a generally straight line, and may have a length L1 sized to span the first 5 or 6 lace-holes of the ice-skate.

Referring again to FIG. 1, the lace-holes 104*a* and 104*b* further curve inwardly on the ice-skate at the ankle portion of the ice-skate. That is, the ankle portion of the ice-skate is narrower than the foot portion. Further, it will be appreciated that when the ice-skate is worn, the degree to which the lace-holes 104*a* and 104*b* curve inwardly will vary, depending for example upon the diameter of the wearer's ankle, and upon how tight the skate is laced. As shown most clearly in FIG. 3, the first weighted member 110*a* is flexible, in so that it may conform to the contour of the side 106*a* of the ice-skate. More particularly, if the first end 112*a* of the weighted member 110*a* is held fixed, the second end 114*a* may move side to side, in a direction indicated by arrow A1 in FIG. 3.

In the embodiment shown in FIGS. 9 and 10, the lace-holes 904*a* and 904*b* do not curve inwardly on the footwear. However, the lace-holes 904*a* and 904*b* may not lie in a flat plane on the footwear. For example, in use, depending on the contour of the shoe, the shape of the user's foot, and the tightness of the shoelaces, the lace-holes 904*a* and 904*b* may not be co-planar. Accordingly, in such embodiments, by providing a flexible weighted member 110*a*, the weighted member may conform to the contour of the side of the shoe.

In use, in order to secure the weight 100 to the piece of footwear, the first weighted member 110*a* may be applied to the outer side 106*a* of the piece of footwear 102, the second weighted member 110*b* may be applied to the inner side 106*b* of the piece of footwear, and then the first weighted member 110*a* and the second weighted member 110*b* may be secured to the outer side 106*a* and inner side 106*b*, respectively, of the piece of footwear. More particularly, referring back to FIGS. 1 and 2, the shoelace 108 may first be removed from the piece of footwear 102. The first weighted member 110*a* may then be positioned on the outer side 106*a* of the piece of footwear 102 such that the holes 120*a* align with the lace-holes 104*a*, and the second weighted member 110*b* may be positioned on the inner side 106*b* of the piece of footwear 102 such that the holes 120*b* align with the lace-holes 104*b*. The piece of footwear may then be laced up, to secure the first 110*a* and second 110*b* weighted members to the piece of footwear 102. More particularly, the shoelace 108 may then be threaded through the first plurality of lace-holes 104*a*, the first plurality of holes 120*a*, the second plurality of lace-holes 104*b*, and the second plurality of holes 120*b*. The shoelace 108 may then be tied to removably secure the weighted members 110*a*, 110*b* to the piece of footwear.

In order to remove the weight 100 from the piece of footwear 102, the shoelace 108 may be untied and removed from the piece of footwear 102.

It will be appreciated that steps of positioning the first 110*a* and second 110*b* weighted members on the piece of footwear 102 and securing the first 110*a* and second 110*b* weighted members on the piece of footwear 102 may be carried out concurrently.

As illustrated in FIGS. 1 to 10, each weighted member 110 has a plurality of holes 120 defined therethrough. The holes 120 are generally arranged to align with lace-holes 104 of a piece of footwear, so that the shoelace 108 may be threaded through holes 120 and 104 to removably secure the weighted members 110 to the piece of footwear. Reference is now made to FIGS. 11 to 15, which illustrate another example embodiment of a weighted member. In FIGS. 11 to 15, like features as in FIGS. 1 to 10 are referred to with like reference numerals, with the first digit incremented to 5.

As illustrated in FIGS. 11 to 15, the weighted member 510 has a generally elongate body and has a perimeter 515, a first end 512, a second end 514, and a length L1 extending therebetween. The weighted member 510 further has a first face 516 extending along the length thereof, and a second face 518 extending along the length thereof and opposed to the first face 516. In use, the weighted member 510 is applied to a piece of footwear by positioning either the first face 516 or the second face 518 in facing relation to either the outer side 106*a* or the inner side 106*b* of the piece of footwear 102.

The weighted strip 510 has a plurality of holes 520 defined therethrough, which are arranged along the length L1 of the weighted member 510. The holes each have a perimeter 525, and extend through the weighted member 510 from the first face 516 to the second face 518. The holes 520 are generally arranged to align with the first plurality of lace-holes 104 of the piece of footwear when the weighted member 510 is placed on the piece of footwear 102, so that the shoelace 108 may be threaded therethrough. In the illustrated example, they are aligned along a common axis 521, although this need not be the case in alternative embodiments.

Preferably, the number of holes 520 in the weighted member 510 corresponds to the number of lace-holes 104*a* in the piece of footwear 102. In alternative embodiments, however, the number of holes 520 in the weighted member 510 may not correspond to the number of lace-holes 104*a* in the piece of footwear 102. Preferably, the weighted member 510 comprises at least three holes 520, to provide three points of connection between the weighted member 510 and the piece of footwear 102.

Figure 13:
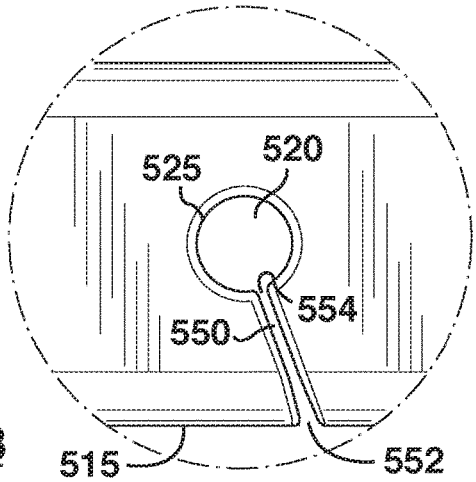
FIG. 13 is an enlarged view of the circled area 13 of FIG. 12.
Figure 14:
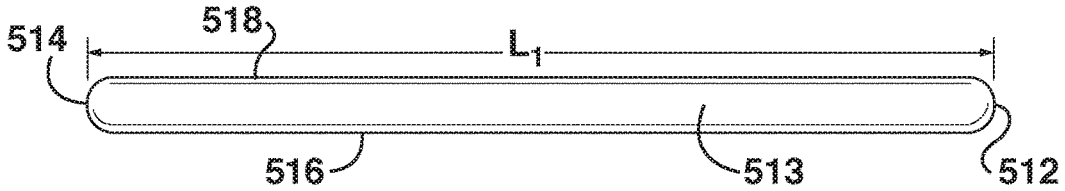
FIG. 14 is a front view of the weight of FIG. 11.

In the illustrated example, a channel 550 extends between the perimeter 525 of each hole 520 and the perimeter 515 of the weighted member 510. As shown in FIG. 13, each channel 550 has an outer end 552 at the perimeter 515 of the weighted member, and an inner end 554 at the perimeter 525 of a hole 520.

Figure 15:
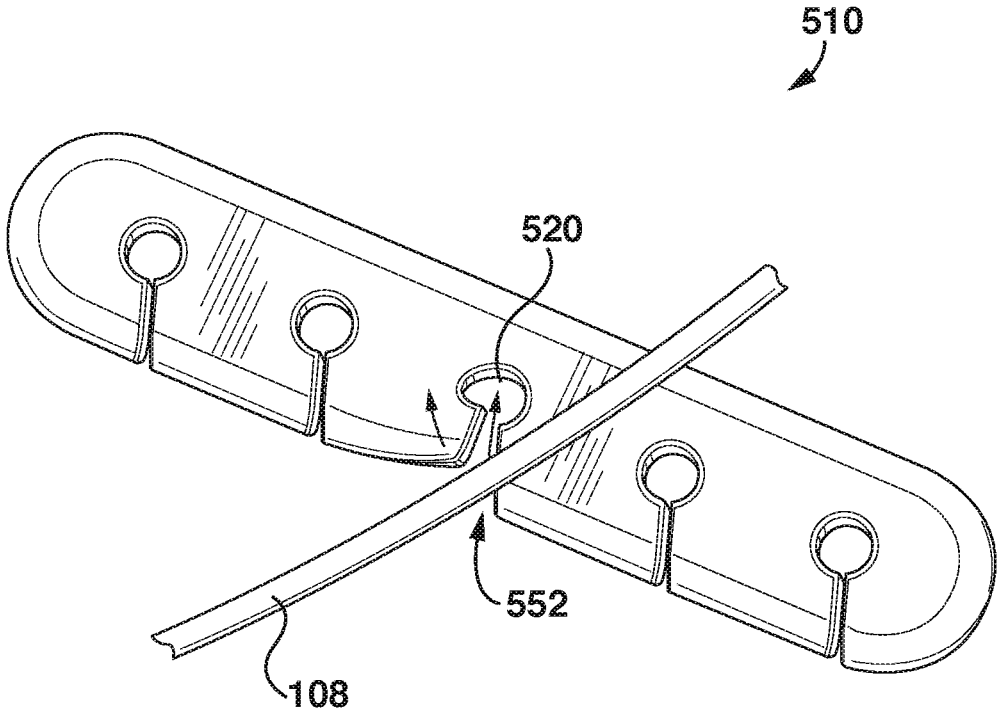
FIG. 15 is a perspective view of the weight of FIG. 11, with the body of the weight twisted and a lace passing through a channel and into a hole in the body of the weight.

An advantage of this design is that channels 550 may facilitate securing the weighted member 510 to a piece of footwear without requiring its lace to be unthreaded and re-threaded through the weighted member. As illustrated in FIG. 15, weighted member 510 is preferably flexible (e.g. resilient or malleable) such that the body may be twisted or otherwise deformed so as to increase the effective width of channel 550 such that a shoelace 108 may be positioned in hole 520 without having to thread an end of the shoelace through the hole 520. For example, a user may only need to loosen the lacing of the piece of footwear, slot the shoelace 108 through the channels 550 and into holes 520 (e.g. while twisting the body of weighted member 510) while aligning the holes 520 with lace-holes 104 on the piece of footwear, and then tighten the lacing to secure the weighted member 510 to the piece of footwear 102. It will be appreciated that aligning the holes 520 with lace-holes 104 and slotting the shoelace 108 through the channels 550 may be carried out in either order or concurrently.

Another advantage of this design is that in order to remove the weighted member 510 from the piece of footwear 102, the shoelace 108 may only need to be loosened to allow the lace to be removed from holes 520 via channels 550, as opposed to having to unlace the piece of footwear.

Figure 16:
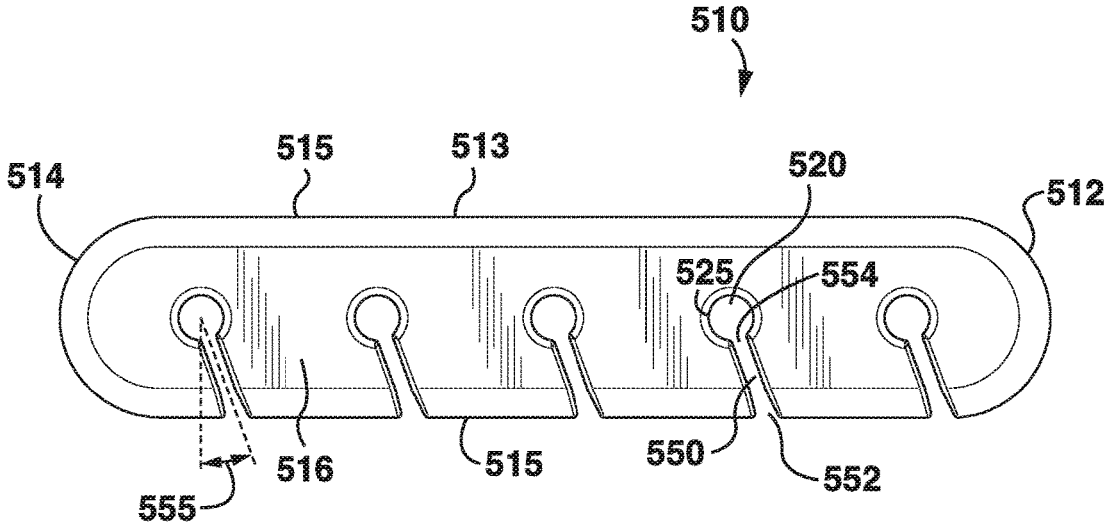
FIG. 16 is a side view of another alternative embodiment of a weight.
Figure 17:
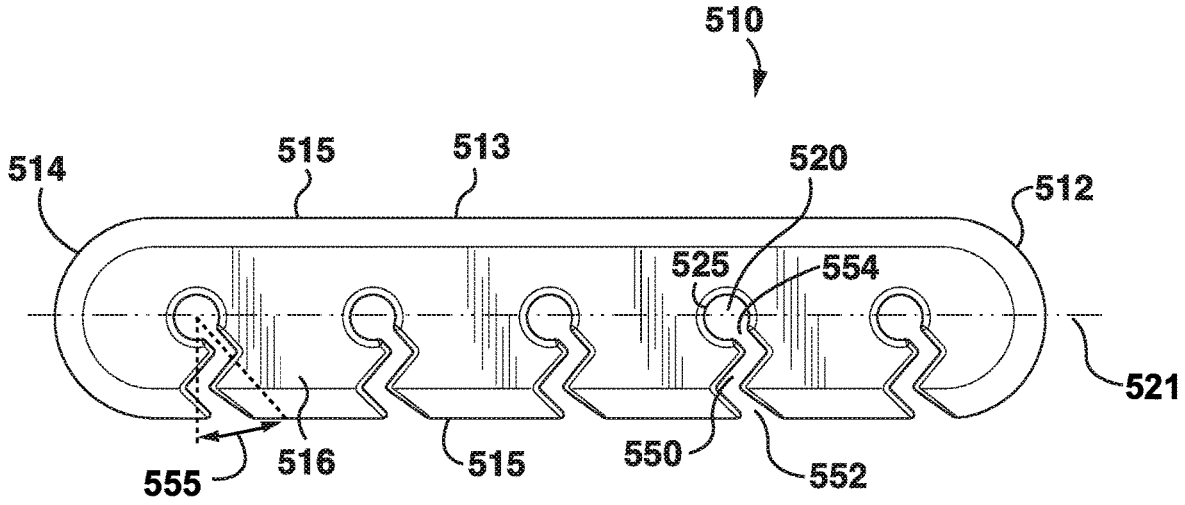
FIG. 17 is a side view of another alternative embodiment of a weight.

In some embodiments, the outer end 552 of channel 550 may be rounded, chamfered, or beveled such that a width of the channel 550 at the perimeter 515 is greater than a width of the channel at the perimeter 525. Channel 550 preferably has a width that is less than a diameter of a typical shoelace. For example, channel 550 may have a width of about 0.060 inches at the outer end 552 and a width of about 0.044 inches at the inner end 554. In a preferred embodiment, channel 550 may have a width of about 0.080 inches at the outer end 552 and a width of about 0.062 inches at the inner end 554. FIG. 16 illustrates an example embodiment of a weighted member 510 that has relatively wider channels than the example weighted member 510 illustrated in FIGS. 11 to 15. In the examples illustrated in FIGS. 11 to 17, the maximum width of each channel 550 is less than the maximum width $W_1$ of a corresponding hole 520. The maximum width of the hole is taken along a first line perpendicular to a second line (such as, for example, axis 521 shown in FIG. 12) that extends longitudinally along the body and passes through the hole.

In the examples illustrated in FIGS. 11 to 16, channels 550 are generally linear or straight. Alternatively, channels 550 may have a zig-zag shape, as illustrated in the example shown in FIG. 17, or any other suitable shape.

Figure 12:
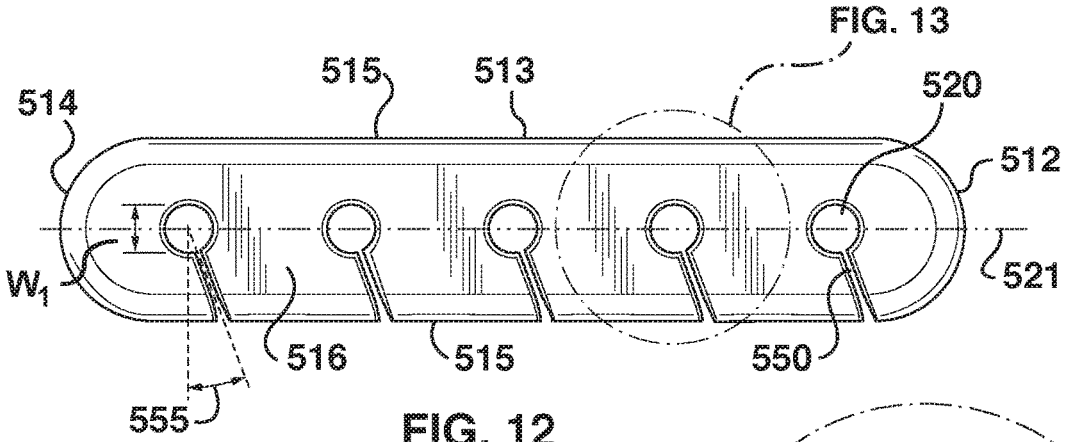
FIG. 12 is a side view of the weight of FIG. 11.

In the illustrated example, each channel 550 intersects the perimeter 515 of the weighted member 510 at an angle 555 (see FIG. 12). Alternatively, this arrangement may be characterized as the channel 550 extending at an angle of (90°—angle 555) to the axis 521. Preferably, the angle 555 is between about 10° to 30°, and more preferably about 20°. In the example illustrated in FIG. 17, the channel 550 extends at an angle of about 45° to the axis 521. In alternative embodiments, the angle 555 may be about 0°, i.e. the channels are perpendicular to the perimeter 515.

In the illustrated example, each hole 520 has a corresponding channel 550 providing a path to the perimeter 515 of the weighted member 510. In alternative embodiments, one or more of the holes 520 may not have an associated channel 550. For example, the hole closest to either end 512, 514 of the body of weighted member 510 may not have an associated channel. An advantage of this alternative design is that channels 550 provided for the remaining holes 520 may allow the lace of a piece of footwear to be positioned in those holes without requiring the lace to be unthreaded and re-threaded through the weighted member, while requiring the lace to be unthreaded and re-threaded through the hole 520 without a channel 550 may ensure that the weighted member 510 does not inadvertently become detached from the piece of footwear.

As with weighted member 110, in order to provide the weighted member 510 with a desired amount of weight, the weighted member 510 may comprise a weighted portion and a cover. Alternatively, the weighted member 510 may be formed as a unitary member, such that the entire body may be characterized as a weighted portion. The weighted portion may comprise lead, for example, and may be in the form of a lead strip. Alternatively, the weighted member 510 may be manufactured without lead. It will be appreciated that the weighted portion may be made from any suitable material, including other relatively dense metals, alloys, or other multi-material compositions. For example, the weighted member could include a mixture of metals, metal powders, polymers, and/or plastics to produce a member with the desired weight and the flexibility to "twist and turn" or be otherwise deformed to increase the effective width of channel 550 such that a shoelace 108 may be positioned in hole 520 without having to thread an end of the shoelace through the hole 520. For example, the weighted member may be made from plastic with embedded metal and/or metal powder. Preferably, the weighted material has a relatively high density, which may reduce the overall size (e.g. volume) of a weighted member. Preferably, the weighted member has a density of about 3 to 6 grams/cubic centimeter, although it may be lower (as discussed below) or higher.

The weighted member 510 may be designed to have a desired weight, and different weighted members 510 may have different weights. For example, some weighted members 510 may weigh about 2 oz (about 0.125 lb.), and other weighted members 510 may weigh about 4 oz (about 0.25 lb.). Preferably, weighted members 510 may be designed and/or sold as any the following: a 2 oz (0.125 lb) weight, a 3 oz (0.188 lb) weight, a 4 oz (0.25 lb) weight. In order to provide the desired amount of weight, the dimensions (e.g. thickness) of the weighted portion may be altered. Alternatively, or additionally, the material composition of the weighted portion may be varied, e.g. a higher density material may be used to form a heavier weighted member 510. For example, for a weight with an overall volume of 19 cubic centimeters, a 1 oz weight may have an average overall density of 1.492 grams/cubic centimeter, a 2 oz weight may have an average overall density of 2.984 g/cc, a 3 oz weight may have an average overall density of 4.476 g/cc, and a 4 oz weight may have an average overall density of 5.968 g/cc.

In some embodiments, the exterior of weighted member 510 may be color coded to correspond to the weight value of the weighted member 510. For example, weighted members 510 that have a weight of 2 oz may be colored blue, and weighted members 510 that have a weight of 4 oz may be colored red.

In some embodiments (not shown), additional weighted members 110 may be applied to the piece of footwear 102, to increase the weight on the piece of footwear 102. More particularly, a plurality of weighted members may be stacked on the outer side 106*a* of the piece of footwear 102, and a plurality of weighted members may be stacked on the inner side 106*b* of the piece of footwear 102. For example, prior to lacing up the piece of footwear 102, a third weighted member may be applied to the outer side 106*a* of the piece of footwear 102, on top of the first weighted member 110*a*, and a fourth weighted member may be applied to the inner side 106*b* of the piece of footwear 102, on top of the second weighted member 110*b*. The piece of footwear 108 may then be laced up, to secure all four weighted members to the piece of footwear.

It will be appreciated that the weight 100 may be sold in separate parts. That is, weighted members 110*a*, 110*b* may be sold separately. Alternatively, the weighted members 110*a*, 110*b* may be sold together.

It will be appreciated that, although in the embodiments shown, the first 110*a* and second 110*b* weighted members are manufactured as separate pieces, in some embodiments, they may be joined.

As used herein, the wording "and/or" is intended to represent an inclusive—or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A weight for attachment to a piece of footwear, the weight comprising:

an elongate body having a plurality of holes arranged along a length of the body and extending between a first face of the body and a second face of the body, wherein the plurality of holes are aligned along a common axis, wherein a channel extends between a perimeter of one of the plurality of holes and a perimeter of the body, wherein the channel extends at an angle of about 45 to 80 degrees to the common axis, and wherein the channel has a maximum channel width, the one of the plurality of holes has a maximum hole width taken along a first line generally perpendicular to the common axis, wherein the maximum channel width is less than the maximum hole width.

2. The weight of claim 1, wherein separate channels extend between a perimeter of each of the plurality of holes and the perimeter of the body.

3. The weight of claim 2, wherein the separate channels are generally parallel.

4. The weight of claim 1, wherein the body comprises a cover and a weighted portion.

5. The weight of claim 4, wherein the weighted portion comprises a material having a density of about 3 to 6 grams/cubic centimeter.

6. The weight of claim 5, wherein the material comprises at least one of lead, brass, and iron.

7. The weight of claim 4, wherein the cover comprises a first covering strip adjacent to a first face of the body, and a second covering strip adjacent to a second face of the body.

8. The weight of claim 1, wherein the channel is straight.

9. The weight of claim 1, wherein the channel extends at an angle of about 60 to 80 degrees to the common axis.

10. The weight of claim 9, wherein the channel extends at an angle of about 70 degrees to the common axis.

11. The weight of claim 1, wherein a width of an outer end of the channel adjacent the perimeter of the weighted member is greater than a width of an inner end of the channel adjacent the perimeter of the hole.

12. The weight of claim 1, wherein at least a portion of the body is flexible.

13. The weight of claim 1, wherein the body is flexible.

14. The weight of claim 1, wherein the body is resilient.

15. The weight of claim 1, wherein the body is curved.

16. The weight of claim 15, wherein the common axis is curved.

17. The weight of claim 1, wherein the plurality of holes comprises at least three holes.

18. The weight of claim 1, wherein the body comprises a plastic material with embedded metal particles.

19. The weight of claim 18, wherein the body is substantially free of lead.

20. The weight of claim 1, wherein the body has a density of about 3 to 6 grams/cubic centimeter.

* * * * *